US005618001A

United States Patent [19]

Del Gaone et al.

[11] Patent Number: 5,618,001

[45] Date of Patent: Apr. 8, 1997

[54] SPRAY GUN FOR AGGREGATES

[75] Inventors: Peter V. Del Gaone, Drexel Hill, Pa.; Ernest F. Watts, Riverside, Ill.; Walter Dany, Riverdale, N.J.; R. Paul Rossi, Jr., San Carlos, Calif.; Ronald R. Scotchmur, Schiller Park, Ill.

[73] Assignee: Binks Manufacturing Company, Franklin Park, Ill.; by said Ernest Watts, Walter Dany, R. Paul Rossi Jr., and Ronald R. Scotchmur

[21] Appl. No.: 407,320

[22] Filed: Mar. 20, 1995

[51] Int. Cl.[6] ..... B05B 7/30

[52] U.S. Cl. ..... 239/346; 239/527; 239/583

[58] Field of Search ..... 239/346, 290, 239/526, 527, 415, 583, 123, 601, 419

[56] References Cited

U.S. PATENT DOCUMENTS

| | | | |
|---|---|---|---|
| 2,214,035 | 9/1940 | Tracy | 239/290 |
| 2,345,402 | 3/1944 | Lubbock et al. | 239/125 |
| 2,550,888 | 5/1951 | Traughber, Jr. | 277/20 |
| 2,613,997 | 10/1952 | Ball | 239/125 |
| 2,880,976 | 4/1959 | True | 259/151 |
| 2,904,262 | 9/1959 | Deeps | 239/346 |
| 2,971,700 | 2/1961 | Peeps | 239/296 |
| 3,018,968 | 1/1962 | Levey | 239/124 |
| 3,119,531 | 1/1964 | Jacobs | 222/318 |
| 3,123,306 | 3/1964 | Bradley | 239/142 |
| 3,123,307 | 3/1964 | Bradley | 239/336 |
| 3,179,341 | 4/1965 | Plos et al. | 239/414 |
| 3,187,956 | 6/1965 | Dawson | 222/185 |
| 3,277,868 | 10/1966 | Lockwood et al. | 118/410 |
| 3,306,495 | 2/1967 | Wabers | 222/77 |
| 3,375,978 | 4/1968 | Rennie | 239/527 |
| 3,482,781 | 12/1969 | Sharpe | 239/415 |
| 3,504,855 | 4/1970 | Volker | 239/125 |
| 3,587,970 | 6/1971 | Tindall | 239/125 |
| 3,589,610 | 6/1971 | Wahlin | 239/124 |
| 3,606,168 | 9/1971 | Seaman, Jr. | 239/597 |
| 3,819,116 | 6/1974 | Goodinge et al. | 239/125 |
| 3,858,761 | 1/1975 | O'Dell | 222/318 |
| 4,106,699 | 8/1978 | Holt | 239/124 |
| 4,124,045 | 11/1978 | Slywka | 222/318 |
| 4,200,207 | 4/1980 | Akers et al. | 222/318 |
| 4,341,329 | 7/1982 | Kuemmerer et al. | 222/380 |
| 4,535,919 | 8/1985 | Jameson | 239/124 |
| 4,875,625 | 10/1989 | Jones | 239/124 |
| 4,907,741 | 3/1990 | McIntyre | 239/583 |
| 5,078,322 | 1/1992 | Torntore | 239/527 |

*Primary Examiner*—Andres Kashnikow
*Assistant Examiner*—Lisa Ann Douglas
*Attorney, Agent, or Firm*—Dann, Dorfman, Herrell and Skillman, P.C.; Henry H. Skillman

[57] ABSTRACT

A spray gun for spraying fluent materials having a high concentration of particulate matter. The spray gun is connected to a source of pressurized air and a source of spray materials. The air and spray materials mix in a nozzle, atomizing the fluid in the spray materials before the mixture is discharged from the spray gun. A valve is provided to control the flow of the spray materials. A conduit passes through the valve to provide a secondary source of air to atomize the fluid in the spray materials. The valve is also configured to ensure that no spray materials can enter the chamber of the valve when the valve is the closed position.

27 Claims, 5 Drawing Sheets

SPRAY GUN FOR AGGREGATES

FIELD OF THE INVENTION

The present invention relates to spray guns and particularly to spray guns adapted for spraying fluid materials which have a high viscosity and/or a high concentration of particles which may be fibrous and/or abrasive materials; especially particulate loaded mortar, such as plaster or conventional stucco or synthetic stucco which is most commonly called exterior insulation finish systems (E.I.F.S).

BACKGROUND OF THE INVENTION

Previously, in U.S. Pat. No. 5,370,315, the present inventors addressed the problem associated with spraying materials that required continuous circulation. The present invention addresses the problems associated with spraying materials that contain a significant particulate content, but do not require continuous circulation.

When spraying liquids, a liquid and compressed air are mixed in a mixing chamber to atomize the liquid before the mixture exits out a discharge orifice. To provide a proper spray pattern, the liquid must be sufficiently atomized. When using conventional liquids that do not contain a significant particulate content, such as paint, the pressure of the air supplied to the mixing chamber can simply be increased to ensure proper atomization.

When spraying liquids containing a high particulate content, increasing the air pressure has adverse effects. When spraying such liquids on vertical or overhead surfaces, the particles in the mixture tends to bounce off the surface to which the mixture is being applied, instead of adhering to the surface with the liquid. As the pressure of the air supplied to the mixing chamber is increased, the tendency of the particles to bounce off the surface increases.

Proper atomization of the liquid sprayed and proper adhesion of the particles in the liquid,are conflicting problems that are well known. However, conventional spray devices have been unsatisfactory in resolving these problems.

In addition to these problems, when spraying liquids having a high particulate content, the air passages that lead to the mixing chamber must be sufficiently large to introduce an adequate supply of pressurized air for proper atomization of the liquid. At the same time, increasing the size of the air passages increases the amount of material that may flow back through the air passage instead of exiting through the discharge orifice. When using a liquid with high particulate content, this back flow can significantly occlude the air passage, hindering the performance of the spraying apparatus.

Finally, it is beneficial to be able to remove the nozzle periodically during use so that the nozzle can be cleaned or replaced. If the spray device does not provide an adequate seal, the spray materials will have to be depressurized before removing the nozzle. Otherwise spray material would leak through the spray device.

Depressurizing the spray materials wastes significant time because the materials must also be repressurized once the nozzle is replaced. To provide an adequate seal, previous devices have used a resilient sealing component. Such components tend to wear and require replacement, especially if materials having a significant particulate content are used. Therefore, it is advantageous to create a durable seal that does not require replacement.

SUMMARY OF THE INVENTION

With the foregoing in mind, the present invention provides a novel spraying apparatus which has improved means affording proper atomization of liquids having a high particulate content, while decreasing the pressure of the air supplied to the mixing chamber.

By decreasing the pressure of the air introduced to the mixing chamber, the size of the air passages leading to the mixing chamber may be decreased. Decreasing the size of the air passages significantly decreases the amount of particles flowing back through the air passages and causing occlusion.

The present invention provides a spray gun having a valve element with a conduit through which pressurized air passes. The valve controls the flow of spray material into the spray gun.

When the spray material enters the spray gun, it is mixed with a first supply of pressurized air flowing through the conduit in the valve element. This supply of air urges the spray material toward a spray nozzle and begins the process of atomizing the liquid in the spray materials.

When the spray material enters the spray nozzle, a second supply of pressurized air is added and the liquid in the spray material is atomized and then discharged from the spray gun. It was discovered that by adding the air to the spray material in two steps, the pressure of the air used to atomize the spray material can be reduced. This allows the benefits of using lower pressure, while still being able to maintain a proper spray pattern.

The present invention also provides a novel apparatus and method wherein the size of the particles in the spray material corresponds to the size of the discharge orifice in the spray nozzle.

It was discovered that the dimensions of the discharge orifice affected the spray pattern when the discharge orifice was longitudinally elongated. When the lateral width of the discharge orifice is approximately 50 percent larger than the average particle in the spray material, the pressure of the air supplied to the spray gun can be decreased while maintaining a proper spray pattern.

Alternatively, the spray material can be selected with respect to the nozzle-discharge orifice. By selecting spray materials having an approximately one third smaller average size than the lateral width of the discharge orifice, the pressure of the air supplied to the spray gun can be decreased while maintaining a proper spray pattern.

Additionally, the present invention provides means for allowing the spray gun to be used with a variety of spray materials, including materials that do not have significant particulate content.

BRIEF DESCRIPTION OF THE DRAWINGS

All of the objectives of the present invention are more fully set forth hereinafter with reference to the accompanying drawings, wherein.

DESCRIPTION OF THE PREFERRED EMBODIMENTS

Figure 1:
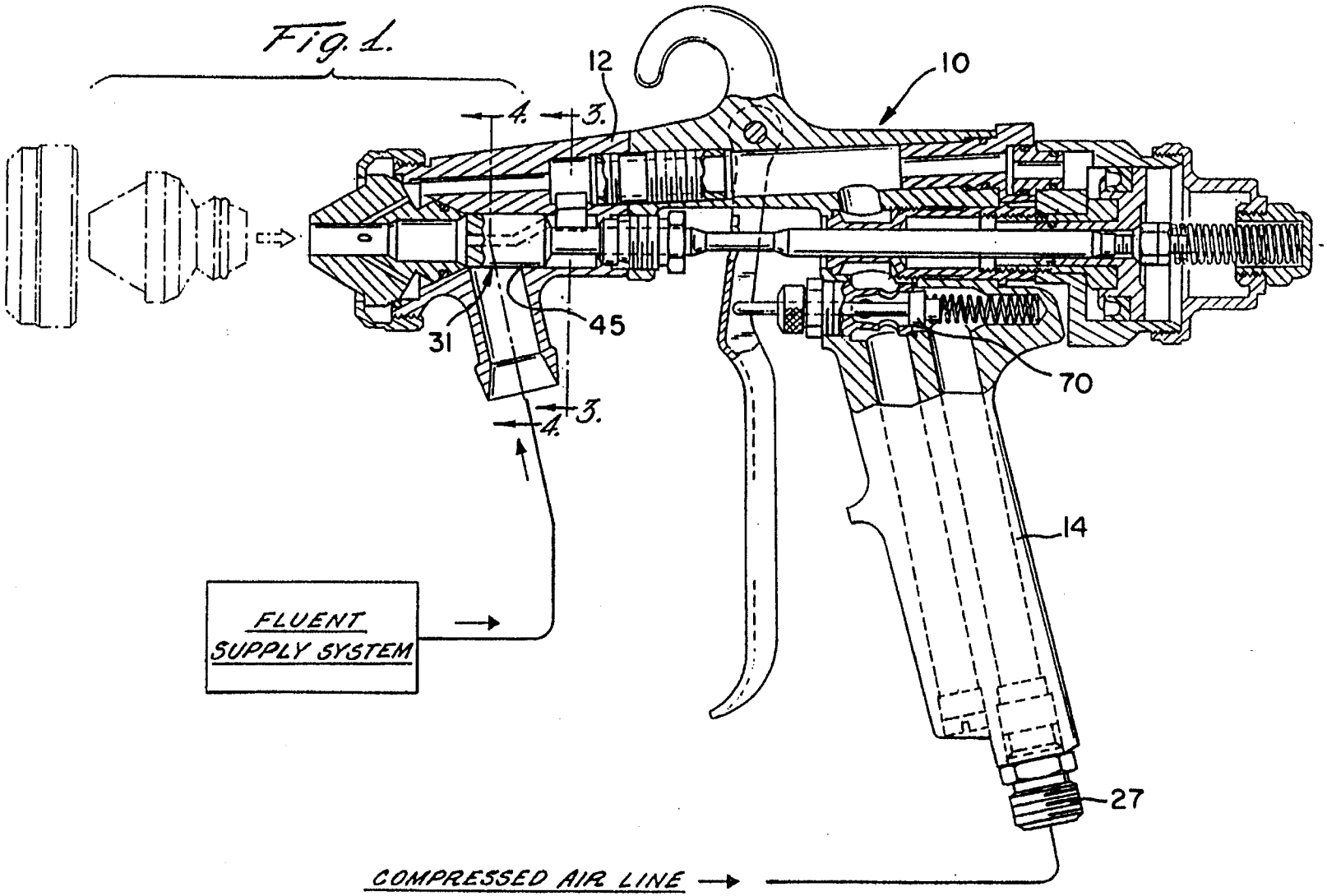
FIG. 1 is a sectional view partially in elevation of a spray gun embodying flow control apparatus for spraying liquid, with phantom lines showing the manner in which the spray nozzle is connected to the spray gun.

Referring now to the drawings in general and FIG. 1 specifically, there is shown a spray gun for spraying fluent materials which have a high concentration of particulate components 10. The spray gun 10 includes a barrel 12, a handle 14, a spray valve 31, an air valve 70, and two inlets, one for pressurized air 27 and one for pressurized spray fluids 45.

The spray gun operates by mixing spray material at a first pressure with air pressurized at a second, preferably lower, pressure to atomize the liquid in the spray material before discharging the mixture. The spray valve 31, located in the barrel 12, controls the flow of the spray materials. The air valve, located in the handle 14, controls the flow of pressurized air.

The spray valve 31 cooperates with the air valve 70 so that when the air valve is in the open position the spray valve is also in the open position, and when the air valve is in the closed position the spray valve is also in the closed position.

Figure 2:
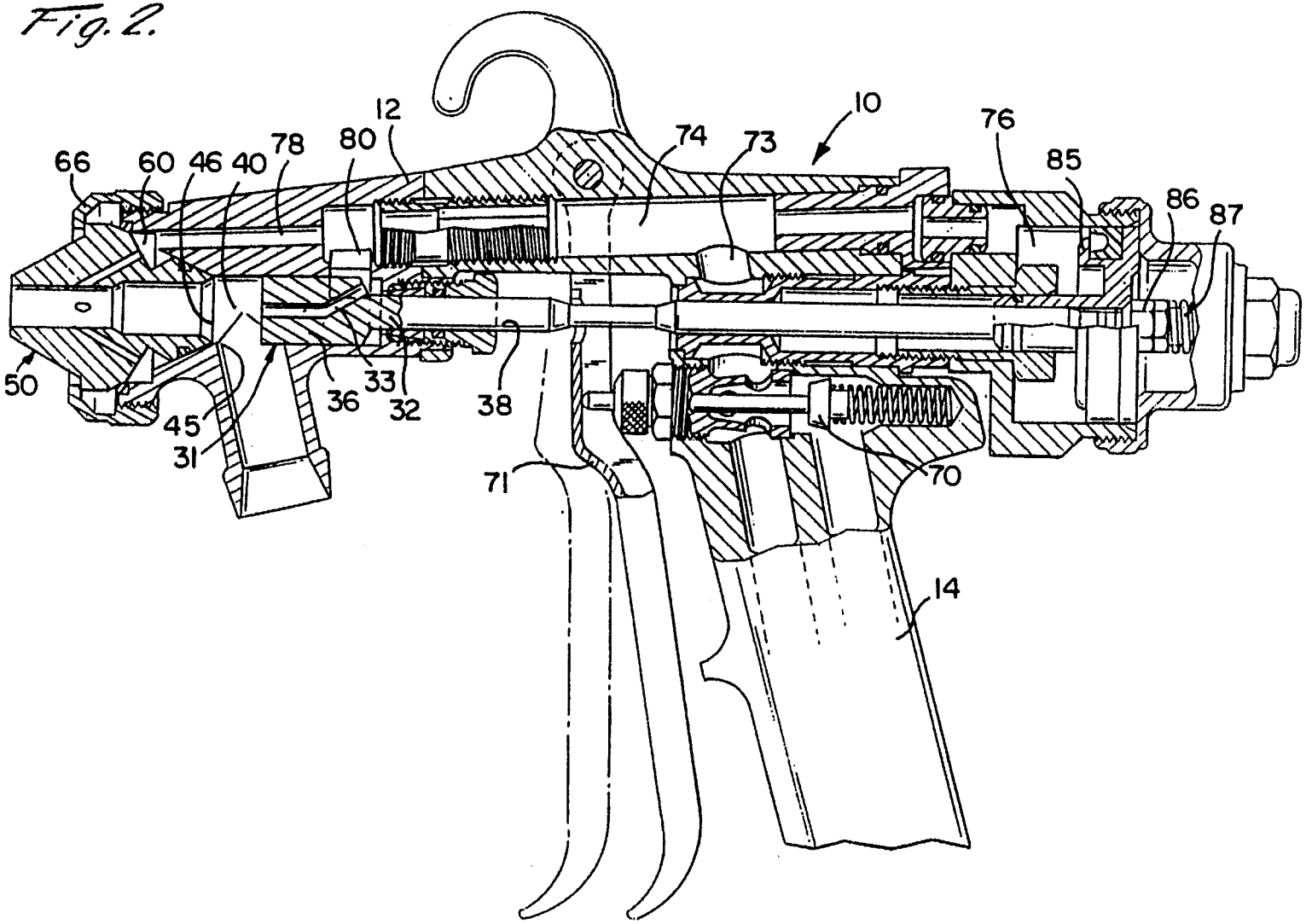
FIG. 2 is a sectional view partially in elevation of the spray gun shown in FIG. 1, with the spray valve and air valve shown in the open position.

The spray material is typically under approximately 25 to 50 psi of pressure, so that when the spray valve 31 is open as shown in FIG. 2, the spray material flows through a spray material port 45 into a valve chamber 40 where it is mixed with a first supply of pressurized air. The spray material then flows into the spray nozzle 50, where a second supply of pressurized air is added to atomize the liquid in the spray material before the mixture is discharged from the spray gun 10.

The spray valve 31 comprises the valve chamber 40 and a valve element 32. The valve chamber has an interior wall, and is preferably shaped so that the interior wall defines an elongated cylindrical bore.

Figure 3:
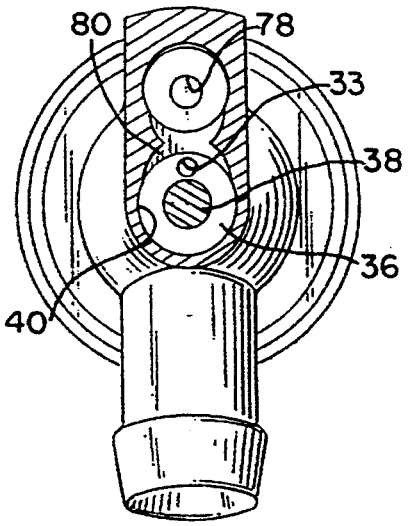
FIG. 3 is a cross-sectional view of the spray gun shown in FIG. 1, taken along line 3—3.

The valve chamber has an inlet for pressurized air, an inlet for spray material, and an outlet for the mixture. The air inlet is a spray valve passage 80 (see FIG. 3) that enters at the rear end of the valve chamber, allowing pressurized air into the valve chamber 40. From there, the pressurized air flows through a conduit 33 in the valve element 32 to the front of the valve chamber. The spray material port 45 enters an intermediate portion of the valve chamber, allowing spray material to flow into the valve chamber. The spray material mixes with the pressurized air and flows out of the valve chamber through the outlet 46 into the nozzle 50.

Within the valve chamber 40, the valve element 32 is slidably displaceable between an open position and a closed position. In the present instance, the valve element 32 has a front cylindrically-shaped body portion 36 and a valve stem 38 projecting from the rear, which preferably has a smaller diameter than the valve body portion.

Figure 4:
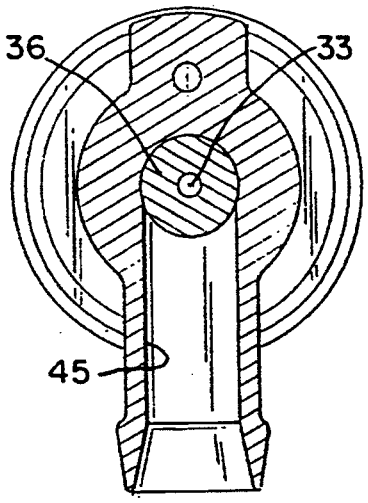
FIG. 4 is a cross-sectional view of the spray gun shown in FIG. 1, taken along line 4—4.
Figure 7:
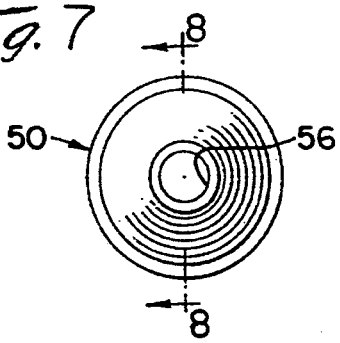
FIG. 7 is a front elevational view of a circular spray nozzle used in connection with the spray gun shown in FIG. 1.

As previously mentioned, a conduit 33 passes through the valve element 32 so that pressurized air can flow from the spray valve passage 80 through the valve element into the front of the valve chamber. As shown in FIG. 4, preferably the front portion of the conduit 33 is coaxial with the valve body 36, and opens to the front of the valve element. The rear portion of the conduit preferably angles toward the outer edge of the valve element so that the conduit opens to the rear of the valve body 36 into an annular space surrounding the valve element within the valve chamber 40.

To operate properly, the clearance between the outside diameter of the valve body 36 and the valve chamber bore must fall between two limits. To allow the valve element to slide within the valve chamber, the sliding clearance must be greater than zero, i.e. the diameter of the valve body must be smaller than the valve chamber bore.

The upper limit of the sliding clearance is dictated by the size of the particles in the spray material. The sliding clearance should be no greater than the size of the average particle in the spray material, so that it impedes passage of the particles through the sliding clearance space between the valve body 36 and the valve chamber 40.

The particles that cannot pass through the sliding clearance space agglomerate around the spray material port 45 when the spray valve 31 is closed as shown in FIG. 1. This agglomeration of particles forms a seal preventing the liquid in the spray material from leaking through the sliding clearance space into the valve chamber 40 when the spray valve 31 is closed. Such a seal allows the nozzle 50 to be removed and cleaned or replaced while the spray material is under pressure with little or no leakage.

When spray materials are used that do not contain a significant particulate content, the sliding clearance space should be reduced. Preferably, the sliding clearance falls within a range that prevents passage of spray materials having a viscosity equal to or greater than elastomeric paint, which typically has a viscosity between 3 and 6 poise. When the spray materials are under approximately 100 psi, the maximum sliding clearance to prevent leakage is 0.0075. Preferably, the sliding clearance is approximately 0.00075 inch.

By reducing the sliding clearance to this limited range, the nozzle can be removed without causing leakage even when using spray materials without a significant particulate content. Without the reduced sliding clearance, a resilient seal between the valve body and the valve chamber would be required to prevent leakage of spray materials that do not have a significant particulate content.

When the spray valve 31 is in the open position, the valve element 32 allows spray material to flow through the spray material port 45. To stop the flow of the spray material, the valve element slides over the spray material port. Preferably the valve element slides longitudinally from the open position in the rear of the valve chamber 40, as shown in FIG. 2, to the closed position in the front of the valve chamber, as shown in FIG. 1.

The valve body 36 is sufficiently long to assure that the entire spray material port 45 will be covered when the valve element 32 is in the closed position. Additionally, the nozzle 50 acts as a stop, preventing the valve body 36 from being displaced beyond the spray material port 45, thereby assuring that the spray material port is completely covered when the valve element is in the closed position. By completely covering the spray material port, the valve body prevents spray material from flowing into the chamber 40, and more specifically from flowing into the rear portion of the valve chamber, which would hinder the rearward displacement of the valve element. To be sufficiently long, the length of the valve element 32 should be greater than the longitudinal diameter of the spray material port 45.

The spray material contains particles that can become lodged between the valve body 36 and the valve chamber wall in front of the spray material inlet 45. These lodged particles can impede proper closing of the valve element 32, thereby allowing spray material to leak past the valve element when the valve element is displaced toward the closed position.

To prevent build up of lodged particles, the valve body 36 and the spray material port 45 have cooperating sharp edges. The front of the valve body 36 is preferably planar, having a sharp edge on the outer perimeter. The spray material port 45 has a sharp outline in the wall of the valve chamber 40.

A shearing clearance is provided between the sharp edge of the valve body and the sharp outline of the port that is less than the average diameter of the particles in the spray materials. Therefore, as the valve body 36 sweeps across the spray material port 45, the sharp edge cooperates with the sharp outline to provide a shearing action. This shearing action displaces any particulate matter that might tend to become lodged and impede proper closing of the spray valve 31. In the present case, the shearing clearance is equal to the sliding clearance described above.

As previously mentioned, the spray valve 31 cooperates with the air valve 70 located in the handle 14. A trigger mechanism 71 activates the air valve 70, so that when the trigger is pressed the air valve opens. When open, the air valve allows pressurized air to flow through the air supply inlet 27 into the spray gun 10. When the trigger 71 is released, the air valve 70 closes shutting off the air supply.

When the air valve is open (see FIG. 2), air flows into the lower air passage 73 in the handle 14 of the spray gun. From there the air flows into the upper air passage 74 in the barrel 12 of the spray gun. The pressure of the air supply displaces a piston 85 in the rear air chamber 76; the remaining air supply flows through the upper air passage toward the nozzle 50.

The piston 85 cooperates with the valve stem 38, so that the spray valve opens as the air pressure displaces the piston. In the present instance, a nut 86 secures the piston onto the valve stem 38. The position of the nut 86 on the valve stem 38 relative to the piston 85 can be adjusted, so that the open position of the valve element 32 is adjustable.

Behind the piston 85, a spring 87 urges the valve stem 38 forward, displacing the valve element 32 toward the closed position when the air valve 70 is closed. The air pressure against the piston 85 must be sufficient to overcome the bias of the spring 87 so that the valve element 32 can be displaced to the open position.

The air supply flowing through the upper air passage 74 toward the nozzle 50 divides into two streams. One stream flows into the spray valve passage 80, which connects the upper air passage 74 to the rear part of the spray valve chamber 40. The second stream flows into the air plenum passage 78, which connects the upper air passage with an air plenum 60 surrounding the nozzle 50.

The air flow through the spray valve passage 80 enters the rear of the valve chamber 40 then flows through the conduit 33 in the valve body 36 into the front of the valve chamber. The air flowing through the valve body 36 combines with the spray material and urges the spray material toward the nozzle 50.

Figure 8:
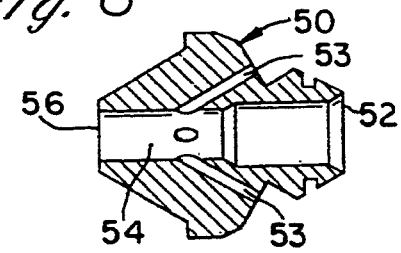
FIG. 8 is a cross-sectional view of the spray nozzle shown in FIG. 7 taken along line 8—8.

The spray material enters the nozzle through an internally tapered mouth 52 (see FIG. 8). The spray material flows through the nozzle mouth into a mixing chamber 54. In the mixing chamber, the spray material is again combined with pressurized air that flows through the nozzle passages 53 leading from the air plenum 60. The pressurized air atomizes the liquid in the spray materials before the mixture exits through the discharge orifice 56.

As mentioned above, in addition to atomizing the liquid in the spray materials, the pressurized air displaces the piston 85. The air pressure required to displace the air piston is typically higher than the air pressure required to atomize the spray material liquid and create proper spray patterns. Therefore, a throttling valve 62 is preferably placed in the upper air passage 78 to variably control the air pressure flowing to the nozzle.

Figure 5:
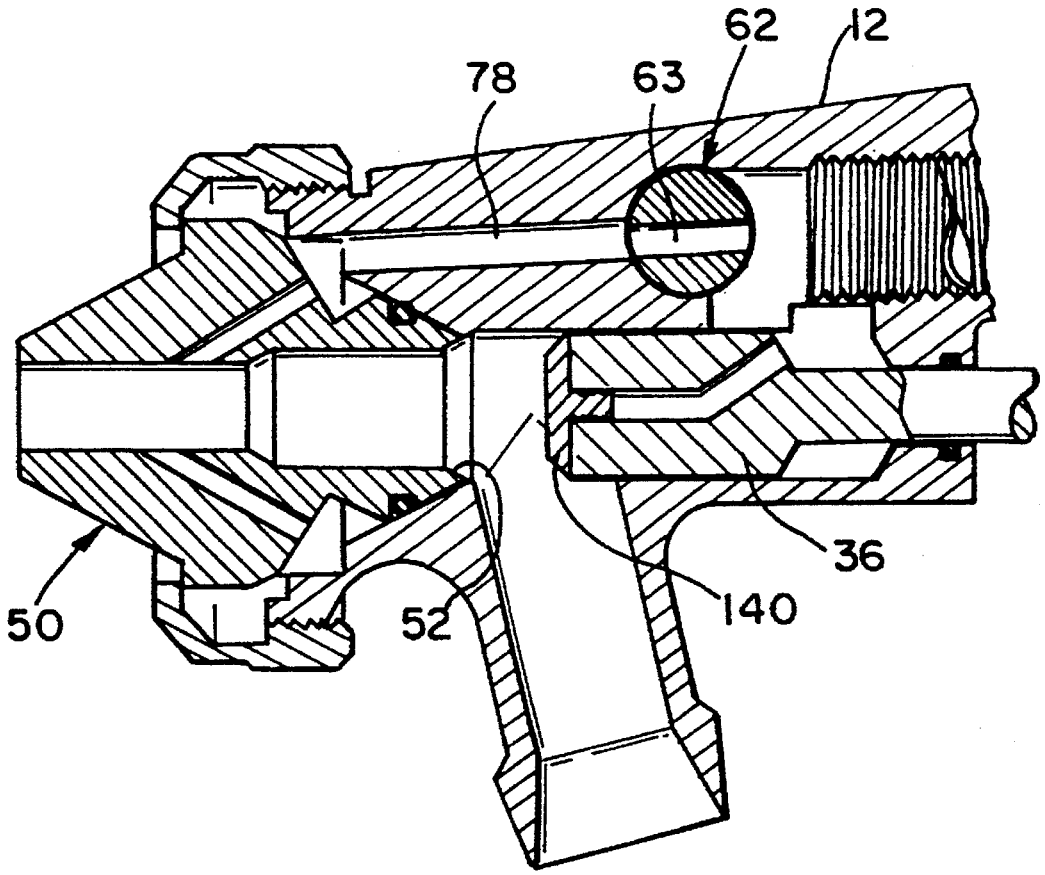
FIG. 5 is a sectional view partially in elevation of the front portion the spray gun shown in FIG. 1, shown with a throttling valve and a tapered bevel attachment.
Figure 6:
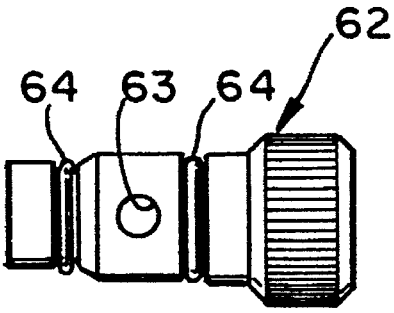
FIG. 6 is a side elevational view of the throttling valve shown in FIG. 5.

As illustrated in FIGS. 5 and 6, the throttling valve 62 is preferably cylindrically shaped having a through-bore 63 passing through it. The axis of the through-bore is transverse the axis of the cylindrical control valve. The throttling valve 62 is positioned in the barrel 12 so that the cylindrical axis of the throttling valve is transverse the axis of the upper air passage 78. Additionally, the throttling valve 62 is positioned so that the through-hole 63 allows air to flow through the air plenum passage 78 as shown in FIG. 5. In the present case, two resilient o-rings 64 form a seal between the barrel 12 and the throttling valve 62, preventing air from leaking out of the spray gun around the throttling valve.

The throttling valve 62 is rotatable within the barrel 12. As the throttling valve is rotated, the through-bore 63 misaligns with the air plenum passage 78, so that part of the through-bore is blocked by the barrel 12. This reduces the flow area of the through-bore, thereby reducing the air pressure forward of the throttling valve.

When the valve element 32 is displaced to the closed position, it contacts the nozzle mouth 52 to form a secondary seal, preventing spray material from leaking. However, particles in the spray material may lodge between the nozzle mouth and the valve element hindering the seal.

To prevent the build up of lodged particles between the valve element 32 and the nozzle 50 the nozzle mouth 52 preferably has a sharp circular edge. The circular edge cooperates with the planar front surface of the valve body 36. As the planar surface of the valve body approaches the circular edge, any particles that might tend to become lodged are displaced or disintegrated.

The nozzle 50 is removable from the spray gun 10 so that different nozzles can be used, allowing the spray gun to create a variety of spray patterns. A variety of means for removably connecting the nozzle to the spray gun can be used. In FIG. 1, a threaded cap 66 cooperates with threads on the barrel to connect the nozzle. However, the preferred means for connecting the nozzle is a standard quick release means (not shown).

Different spray patterns are produced by altering the configuration of the discharge orifice of the nozzle. Two different nozzles are illustrated in FIGS. 7–10, namely: a circular nozzle 50 and a fan nozzle 90.

The circular nozzle 50, which has a circular discharge orifice 56 that is coaxial with the mixing chamber 54, is shown in FIGS. 5 and 6. Such a nozzle can be modified by altering the diameter of the discharge orifice.

Figure 9:
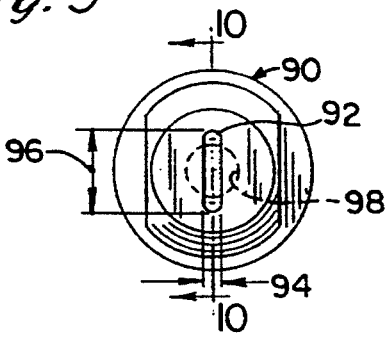
FIG. 9 is a front elevational view of a fan spray nozzle that may be used in connection with the spray gun illustrated in FIG. 1.
Figure 10:
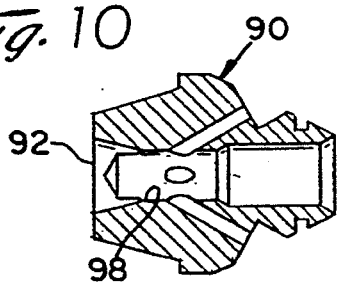
FIG. 10 is a cross-sectional view of the fan spray nozzle shown in FIG. 9 taken along line 10—10.

The second type of nozzle 90 is a fan nozzle having an elongated discharge orifice 92, as illustrated in FIG. 9 and 10. Such an orifice has a lateral width 94 and an elongated height 96. The lateral width is smaller than both the elongated height 96 and the diameter of the mixing chamber. Additionally, the elongated height is preferably greater than the diameter of the mixing chamber 98.

To aid in the atomization of the liquid in the spray material, the lateral width 94 of the discharge orifice should fall between an upper and a lower limit. The lower limit is the average diameter of the particles in the spray materials. If the lateral width 94 is less than the average particle diameter, the particles will tend to occlude the discharge orifice 92 hampering the spray pattern.

The upper limit is twice the average diameter of the particles in the spray material. By making the lateral width 94 smaller than the upper limit, only one particle can pass through the nozzle at any one time at a certain point along the elongated height 96 of the discharge orifice. Preferably, the lateral width 94 is approximately fifty percent greater than the average particle diameter.

Alternatively, the spray material can be selected with respect to the lateral width 94. The spray material is selected so that the particles in the spray material have an average thickness that is one third smaller than the lateral width 94.

As previously discussed, the front portion of the valve element 36 defines a sharp edge that cooperates with the sharp outline of the spray material port 45 to prevent particulate matter from building up. The spray gun does not require this sharp edge if it is used with a spray material that does not contain a significant particulate content. However, when using such spray materials, a secondary closure means is desirable in addition to the closure of the valve element over the spray material port. A secondary closure means is desirable because the spray materials do not contain the particles that agglomerate to form a seal around the spray material port 45 when the spray valve 31 is closed, as described above.

Figure 11:
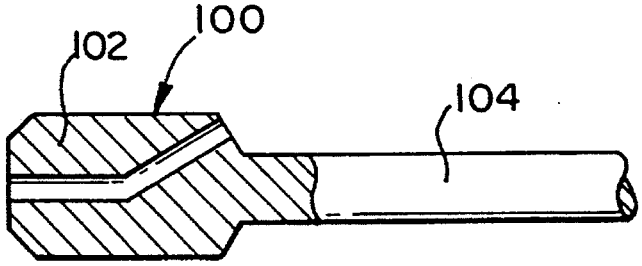
FIG. 11 is a sectional view of an alternate spray valve element used in the spray gun shown in FIG. 1 when using spray materials that do not contain significant particulate content.

To provide a secondary closure between the valve element and the nozzle, the valve element with a sharp edge is removed and replaced with a valve element 100 having a tapered bevel 102 at its forward end, as illustrated in FIG. 11. The tapered valve element 100 has a conduit 103 and a valve stem 104 extending rearwardly, similar to the conduit 33 and the valve stem 38 of the valve element 32 in FIG. 2. For some spray materials, the conduit 103 may be unnecessary and therefore may be eliminated.

The angle of taper of the tapered bevel is similar to the angle of taper of the internal taper of the nozzle mouth. Additionally, the length of the tapered bevel is at least as long as the internal taper of the nozzle. The angle and length of the tapered bevel allows it to mate with and cooperate with the internal taper of the nozzle mouth 52, so that in the closed position, the tapered valve element 100 extends into contact with the nozzle mouth preventing spray materials from leaking through the spray gun 10.

Figure 12:
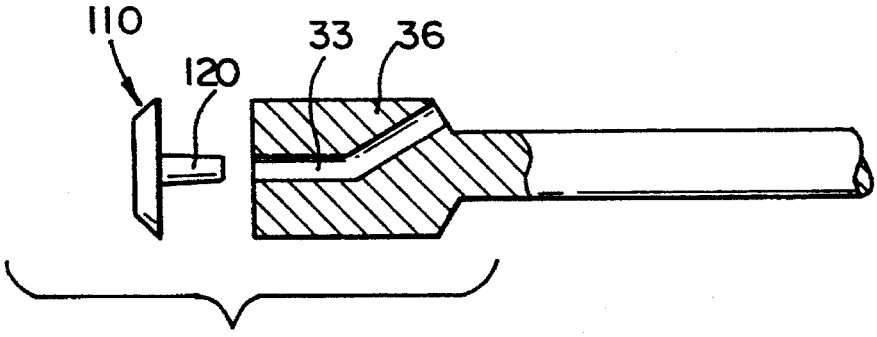
FIG. 12 is a sectional view of a tapered attachment used in the spray gun shown in FIG. 1, when using spray materials that do not contain significant particulate content.
Figure 13:
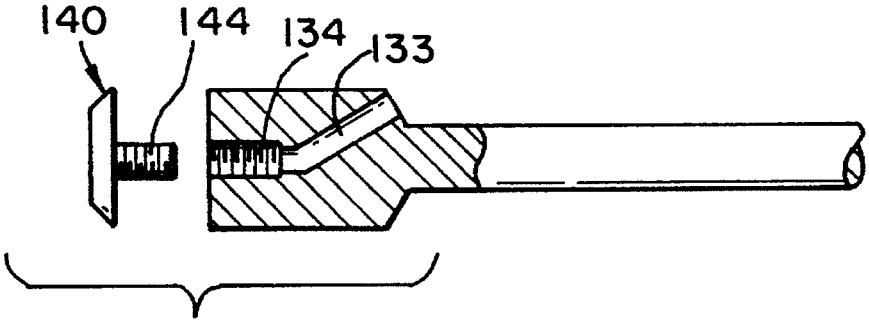
FIG. 13 is a sectional view of a threaded tapered attachment used in the spray gun shown in FIG. 1, when using spray materials that do not contain significant particulate content.

Instead of replacing the entire valve element 32, the tapered attachments illustrated in FIGS. 12 and 13 can be connected to the valve body 36. These attachments provide a tapered bevel at the forward end of the valve elements, and block the conduit 33 so as to allow the same valve element to be used for different spray materials regardless of the particulate content.

The preferred tapered attachment is illustrated in FIGS. 5 and 13. The attachment is tapered on the forward side to mate with and cooperate with the internal taper of the nozzle mouth 52. On the rear side, the attachment is generally planar to mate with the front of the valve body 36, which is preferably planar. A threaded stem 144 extends rearwardly from the attachment, having external threads at the distal end. The valve element iS modified so that the conduit 133 has internal threads 134 to receive the threaded stem 144, as shown in FIGS. 5 and 13.

An alternate construction of the attachment is illustrated in FIG. 12. The tapered attachment is flat on one side and tapered on the other like the attachment illustrated in, FIG. 13. The attachment connects to the valve element via an elongated frustoconical stem 120 extending from the planar side.

The stem 120 extends into the conduit 33 in the valve body 36, forming an interference fit. Preferably the tapered attachment 110 is made from a compressible material such as a plastic or rubber material, and the largest diameter of the stem 120 is larger than the diameter of the conduit 33. This compressibility allows a secure interference fit between the conduit and the stem.

Both tapered attachments shown in FIGS. 12 and 13 are shown without a conduit. If the conduit 33 or 133 needs to be open forward portion of the valve chamber, a through-hole (not shown) may be provided through the body and stem of the attachments. The through-hole allows air to pass through the valve body and the attachment, so that it mixes with the spray materials.

While particular embodiments of the present invention have been herein illustrated and described, it is not intended to limit the invention to such disclosure, but changes and modifications may be made therein and thereto within the scope of the following claims.

We claim:

1. A spray gun for spraying fluent materials which have a high concentration of particulate content said gun comprising:

a valve chamber, a spray nozzle connected to said valve chamber at one end thereof, an air inlet in the valve chamber operable to be connected to a supply of air under pressure, and a spray material inlet in the valve chamber for receiving the spray materials;

a valve element displaceable in said valve chamber between a closed position and an open position, said valve element having a front end confronting said nozzle and defining a movable rear wall of said valve chamber, and a conduit opening into said valve chamber adjacent said rear wall to comprise said air inlet so that when said valve element is in an open position air flows from said air inlet and said conduit into said valve chamber and toward said spray nozzle;

said valve element operable in the closed position to cover said spray material inlet, and operable in the open position to allow the spray materials to flow through said spray material inlet into the valve chamber to mix with the air flowing from said conduit, and to discharge through said nozzle.

2. The spray gun according to claim 1 wherein said valve chamber has an interior axial wall defining an elongated hollow cylindrical bore having said spray material inlet opening therethrough, and said valve element has a cylindrically-shaped valve body, said valve chamber having a bore diameter greater than the diameter of said valve body, providing a sliding clearance to afford sliding displacement of said valve element in said bore.

3. The spray gun according to claim 2 wherein said spray material inlet is defined by a port in the cylindrical wall of said valve chamber having a sharp outline, and the perimeter of said valve body has a sharp edge that cooperates with the sharp outline of the port to provide a shearing action upon displacement of said valve element from the open position to the closed position.

4. A spray gun according to claim 3 wherein said particulate content comprises particles having an average thickness of a given dimension, the valve element providing a shearing clearance between said sharp edge and said sharp outline which is equal to or less than said given dimension, whereby displacement of said valve element produces a shearing action displacing the particles that may be positioned between said sharp outline and said sharp edge.

5. A spray gun according to claim 2 wherein said sliding clearance between the valve chamber bore and the valve element is within a range that prevents spray materials having a viscosity at least as great as 3 poise from passing between the valve chamber and the valve element.

6. A spray gun according to claim 5 wherein the maximum sliding clearance is 0.0075 inch.

7. A spray gun according to claim 6 wherein said spray material inlet is defined by a port in the cylindrical wall of said valve chamber having a sharp outline, and the perimeter of said valve body has a sharp edge that cooperates with the sharp outline of the pork to provide a shearing action upon displacement of said valve element from the open position to the closed position, said valve element providing a shearing clearance between said sharp edge and said sharp outline that is equal to said sliding clearance.

8. A spray gun according to claim 2 wherein said nozzle has an inlet defined by a mouth having a sharp edge, said mouth edge cooperating with said valve body whereby displacement of said valve element into the closed position disintegrates or displaces the particles that may be positioned between said valve body and said mouth edge.

9. A spray gun according to claim 1 further comprising an air plenum surrounding said nozzle and an air passage connected at one end to a compressed air source, having a distal outlet which introduces compressed air to said air plenum, wherein said air inlet interconnects said air passage and said valve chamber.

10. A spray gun according to claim 9 wherein said valve element has a valve stem projecting rearwardly out of said valve chamber, said valve stem cooperating with an operator to displace said valve element between the open and closed positions.

11. A spray gun according to claim 10 wherein said operator comprises a pneumatic piston.

12. A spray gun according to claim 11 further comprising a throttling valve so that the air pressure at said air plenum can be variably reduced relative to the air pressure displacing said pneumatic piston.

13. A spray gun according to claim 11 further comprising means to adjust said pneumatic piston relative to said stem, whereby the open position of said valve element is adjustable.

14. A spray gun according to claim 9 further comprising a trigger cooperable with an air valve controlling the flow of compressed air to said air passage, whereby said compressed air is supplied to said air passage concurrently with the displacement of said valve element to the open position.

15. A spray gun according to claim 1 wherein said valve element has an externally tapered front portion and said nozzle has an internally tapered portion mating with and cooperable with said externally tapered front portion.

16. A spray gun according to claim 1 for spraying fluent materials comprising a liquid with a high concentration of particulate content having an average thickness of a given dimension, said nozzle having an elongated discharge orifice providing a fan shaped discharge pattern, said elongated discharge orifice having an elongated height and a shorter lateral width, wherein said lateral width is larger than said given dimension and smaller than twice said given dimension.

17. A spray gun according to claim 16 wherein said lateral width is approximately 50 percent larger than said given dimension.

18. A spray gun according to claim 16 wherein said mixing chamber has a generally cylindrical outline with a selected diameter, said elongated height of the orifice being greater than the diameter of said chamber and said shorter lateral width being smaller than the diameter of said chamber.

19. A spray gun according to claim 1 said valve chamber having an interior axial wall defining an elongated hollow cylindrical bore;

said valve chamber and element having a stop operable in the closed position of the valve element to position said valve element to completely cover said spray material inlet and prevent said fluent material from entering said elongated hollow cylindrical bore.

20. A spray gun according to claim 19 wherein said valve element stop comprises said nozzle.

21. A spray gun for spraying fluent materials which have a high concentration of particulate content having an average thickness of a given dimension, said spray gun comprising:

a spray nozzle having an elongated discharge orifice having a lateral width through which said fluent materials flow, wherein said lateral width is approximately 50 percent larger than said given dimension;

a valve chamber having said spray nozzle connected to said valve chamber at one end thereof, an air inlet at the other end of the valve chamber, and a spray material inlet intermediate said nozzle and said air inlet for receiving the spray materials under pressure;

a valve element pneumatically displaceable in said valve chamber between a closed position and an open position, said valve element having a conduit positioned and arranged so that when said valve element is in an open position air flows from said air inlet through said conduit toward said spray nozzle;

an air passage connected at one end to a compressed air source, having a distal outlet which introduces compressed air to an air plenum surrounding said nozzle, wherein said air inlet extends between said air passage and said valve chamber;

a tapered attachment removably connected to said valve element wherein said nozzle has an internally tapered portion mating with and cooperable with said tapered attachment;

wherein said spray material inlet is defined by a port having a sharp outline, and the perimeter of the front of said valve element has a sharp edge that cooperates with the sharp outline of the port to provide a shearing action upon displacement of said valve element from the open position to the closed position, said valve element providing a clearance between said sharp edge and said sharp outline which is equal to or less than said given dimension, whereby displacement of said valve element produces a shearing action displacing the particles that may be positioned between said sharp outline or said sharp edge.

22. A spray gun for spraying fluent materials, said spray gun comprising:

a valve chamber, a spray nozzle connected to said valve chamber at one end thereof, and a spray material inlet entering said valve chamber for receiving the spray materials under pressure, said valve chamber having an interior axial wall defining an elongated hollow cylindrical bore;

a valve element displaceable in said valve chamber between a closed position and an open position, said valve element operable in the closed position to cover said spray material inlet, and operable in the open position to allow the pressurized spray materials to flow through said spray material inlet into the valve chamber and through said nozzle, said valve element having a cylindrically-shaped valve body, said valve body having a diameter less than the diameter of said valve chamber bore to afford sliding displacement of said valve element in said valve chamber bore;

wherein the clearance between said valve chamber bore and said valve body falls within a range that prevents materials having a viscosity at least as great as 3 poise from passing between the valve body chamber and the valve body, so that said nozzle can be removed when said valve element is in the closed position while the spray materials are maintained under pressure, without a significant amount of spray materials leaking through said clearance.

23. A spray gun according to claim 22 wherein said spray gun includes means to supply spray material at a pressure equal to or less than 100 psi.

24. A spray gun according to claim 22 wherein said clearance is less than 0.0075 inch.

25. A spray gun for spraying fluent materials which have a high concentration of particulate content said gun comprising:

a valve chamber, a spray nozzle connected to said valve chamber at one end thereof and having an internally tapered portion confronting said valve chamber, an air inlet at the other end of the chamber operable to be connected to a supply of air under pressure, and a spray material inlet intermediate said nozzle and said air inlet for receiving spray material under pressure;

a valve element displaceable in said valve chamber between a closed position and an open position, said valve element having a front end confronting said nozzle and a conduit having an opening in said front end, and a tapered attachment mating with said internally tapered portion of the nozzle;

and connecting means removably connecting the tapered attachment to the front end of said valve element;

said valve element operable in the closed position to cover said spray material inlet, and operable in the open position to allow the pressurized spray material to flow through said spray material inlet into the valve chamber and through said nozzle.

26. A spray gun according to claim 25 wherein said tapered attachment connecting means forms an interference fit connection with said conduit in said front end of said valve element.

27. A spray gun according to claim 25 wherein said valve element comprises a threaded bore and said tapered attachment connecting means comprises a threaded stem on said attachment which threadedly engages said threaded bore.

* * * * *